US007383812B2

(12) United States Patent
Katou et al.

(10) Patent No.: US 7,383,812 B2
(45) Date of Patent: Jun. 10, 2008

(54) FUEL INJECTOR

(75) Inventors: Noritsugu Katou, Okazaki (JP); Toyoji Nishiwaki, Anjo (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/700,898

(22) Filed: Feb. 1, 2007

(65) Prior Publication Data

US 2007/0181094 A1 Aug. 9, 2007

(30) Foreign Application Priority Data

Feb. 9, 2006 (JP) ..... 2006-032911
Nov. 2, 2006 (JP) ..... 2006-299442

(51) Int. Cl.
*F02B 5/02* (2006.01)
*F02B 5/00* (2006.01)

(52) U.S. Cl. ..... 123/305; 123/301

(58) Field of Classification Search ..... 123/305, 123/300, 301, 295, 299, 298, 531; 239/408, 239/417.3

See application file for complete search history.

(56) References Cited

U.S. PATENT DOCUMENTS 4,982,716 A * 1/1991 Takeda et al. ..... 123/531
5,224,458 A * 7/1993 Okada et al. ..... 123/531
5,772,122 A * 6/1998 Sugiura et al. ..... 239/408
5,904,299 A * 5/1999 Hans et al. ..... 239/408
5,931,391 A * 8/1999 Tani et al. ..... 239/585.4
6,138,639 A * 10/2000 Hiraya et al. ..... 123/295
6,622,693 B2 * 9/2003 Arndt et al. ..... 123/299
2002/0179039 A1 * 12/2002 Wuerfel ..... 123/298
2002/0185104 A1 * 12/2002 Arndt et al. ..... 123/299

FOREIGN PATENT DOCUMENTS

JP 2005-282420 10/2005

* cited by examiner

*Primary Examiner*—Mahmoud Gimie
(74) *Attorney, Agent, or Firm*—Nixon & Vanderhye PC

(57) ABSTRACT

A fuel injector is disclosed that includes a valve body with a plurality of nozzle holes for injecting fuel in a hollow spray from the fuel injector. The plurality of nozzle holes each include an outlet. The valve body also includes at least one air-introducing aperture with an air outlet port positioned between the outlets of the plurality of nozzle holes. The air-introducing aperture is operable for introducing air into a hollow area of the hollow spray.

6 Claims, 5 Drawing Sheets

FUEL INJECTOR

CROSS-REFERENCE TO RELATED APPLICATION

This application is based on and claims priority to Japanese Patent Application No. 2006-32911, filed Feb. 9, 2006 and Japanese Patent Application No. 2006-299442, filed Nov. 2, 2006, and the disclosures of each are incorporated herein by reference.

TECHNICAL FIELD

The present invention relates to a fuel injector and, in particular, to a fuel injector which injects fuel into a combustion chamber for an internal combustion engine.

BACKGROUND INFORMATION

Referring to JP-2005-282420A, there is known a fuel injector for injecting fuel directly into a combustion chamber, for example. Specifically, JP-2005-282420A discloses a fuel injector with which fuel injected from a nozzle hole in the fuel injector is formed in a substantially hollow conical spray film shape (hereinafter "hollow spray"). This technology discloses a fuel injector with a tip part in which a nozzle hole plate is disposed. A plurality of nozzle holes are formed in the nozzle hole plate in predetermined locations, and a group of fuel jets sprayed from the plurality of nozzle holes forms the hollow spray.

A general means of describing the shape of the fuel spray (i.e., the "spray form") is to use an opening angle inside the spray film within the hollow part of the spray as a form index, wherein the opening angle of the hollow spray is called "a spray angle."

The fuel jet injected from an outlet of the nozzle hole is generally formed into particles due to the friction of the fuel jet with surrounding air. The fuel jet carries away the air causing the friction and surrounding air thereof.

However, the conventional technology suffers from certain disadvantages. More specifically, the conventional fuel injections may not form the hollow spray into a predetermined spray form since pressure in the hollow part inside the spray film may be lower than the surrounding air outside the spray film. Therefore, the spray angle is reduced depending on the predetermined location of the nozzle hole, and the hollow spray may not be in the predetermined form. Furthermore, an ignitable air-fuel mixture may not be formed at a spark location if the spray angle is reduced substantially and the hollow spray shape is not formed in the predetermined form.

In view of the above, there exists a need for a fuel injector that overcomes the above-mentioned problems in the conventional art. The present disclosure addresses this need in the conventional art as well as other needs, which will become apparent to those skilled in the art from this disclosure.

SUMMARY

A fuel injector is disclosed that includes a valve body with a plurality of nozzle holes for injecting fuel in a hollow spray from the fuel injector. The plurality of nozzle holes each include an outlet. The valve body also includes at least one air-introducing aperture with an air outlet port positioned between the outlets of the plurality of nozzle holes. The air-introducing aperture is operable for introducing air into a hollow area of the hollow spray.

BRIEF DESCRIPTION OF THE DRAWINGS

Other objects, features, and advantages of the present invention will become more apparent from the following detailed description made with reference to the accompanying drawings, in which like parts are designated by like reference numbers and in which.

DETAILED DESCRIPTION

First Embodiment

Figure 1:
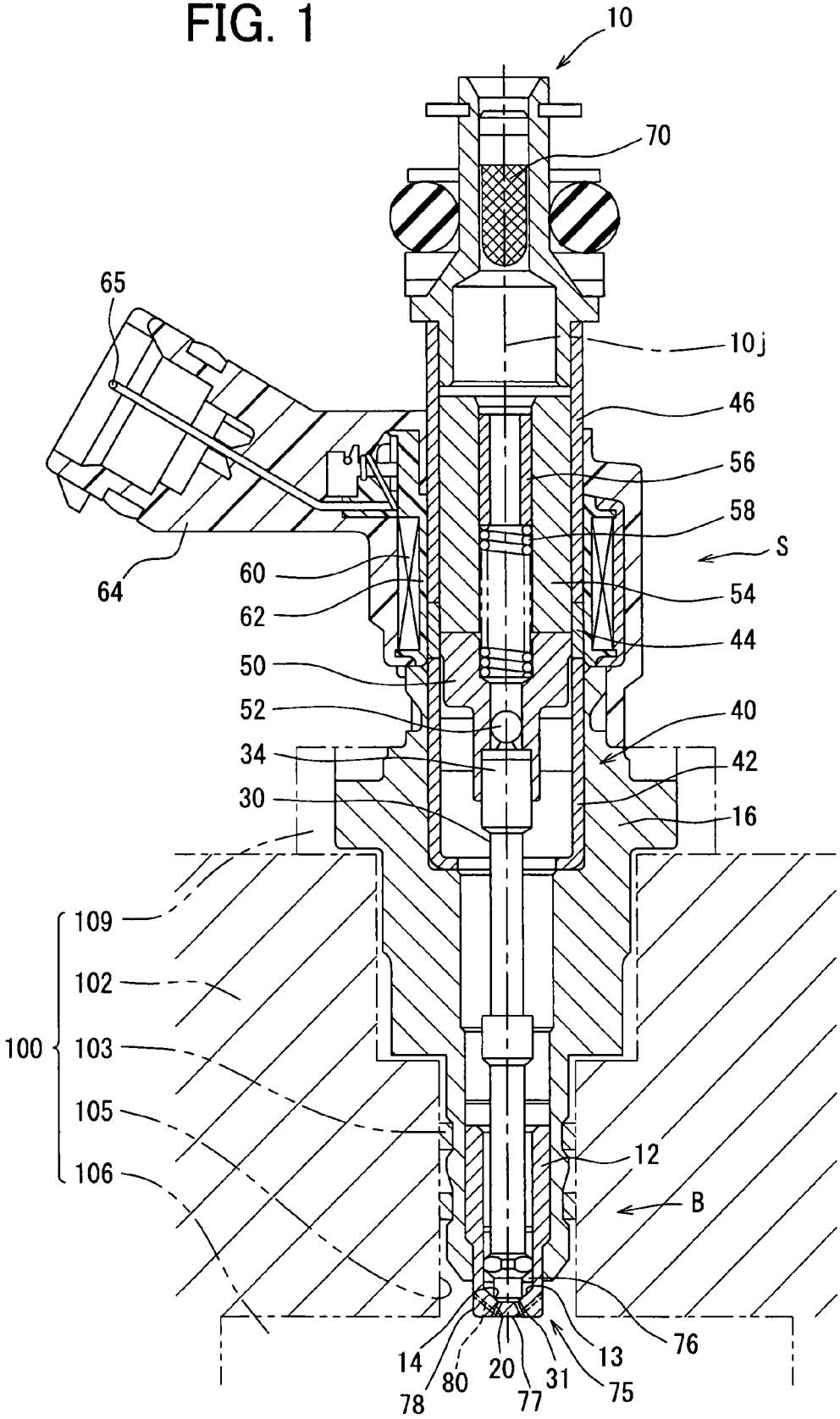
FIG. 1 is a cross sectional view of one embodiment of a fuel injector according to the present disclosure.
Figure 2:
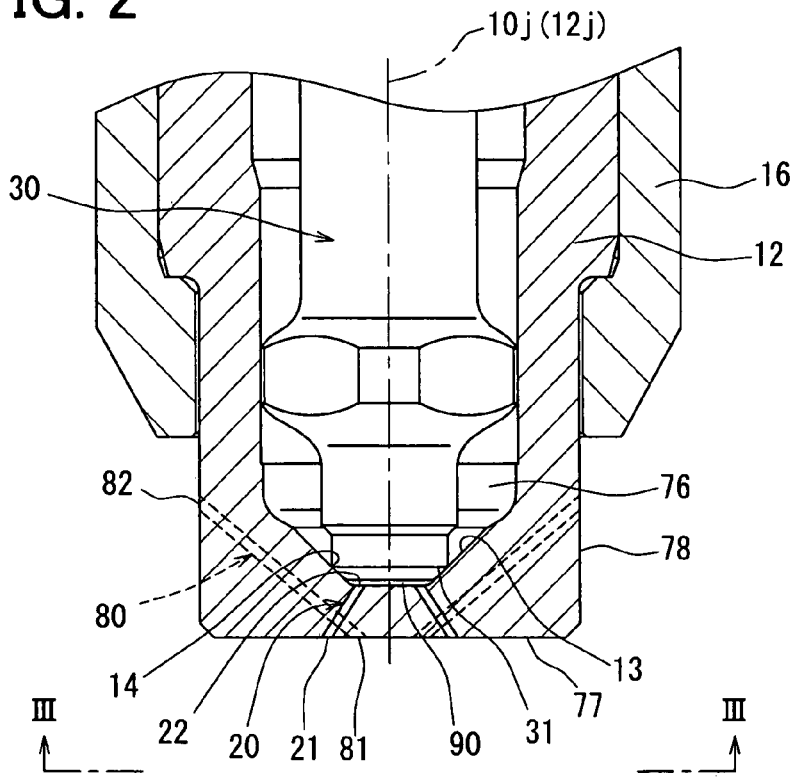
FIG. 2 is a cross sectional view of a tip part of the fuel injector of FIG. 1.

FIG. 1 and FIG. 2 show one embodiment of a fuel injector 10 according to the present disclosure. The fuel injector 10 is shown in a state where the fuel injector 10 has stopped injecting (hereinafter referred to as "closed state of the fuel injector").

In one embodiment, the fuel injector 10 is used for injection of fuel into an internal combustion engine 100 and in particular, a gasoline engine 100. The fuel injector 10 is mounted in each cylinder such as a multi cylinder (for example four-cylinder) of a gasoline engine 100 (hereinafter referred as to "engine"), and injects fuel into a combustion chamber in the cylinder.

The engine 100 (shown in broken lines in FIG. 1) is a well known internal combustion engine which is provided with a cylinder block (not shown), cylinder head 102, a piston (not shown), an inner peripheral wall of the cylinder block, a combustion chamber 106 which is defined by the piston and a ceiling inner wall of the cylinder head 102, a fuel injector 1, and a spark plug (not shown). FIG. 1 is a diagram showing only one of the four cylinders for drawing composition.

A volume of the combustion chamber 106 increases and decreases due to the piston reciprocal motion. The cylinder head 102 is provided with an intake port connected to an intake pipe (not shown) in which an intake gas such as intake air is introduced (not shown), and an exhaust port connected to an exhaust pipe (not shown) to discharge an exhaust gas such as combustion gas (not shown).

The spark plug is a well-known structure including a spark electrode and a ground electrode (not shown) and discharges a spark for igniting a combustible air-fuel mixture. The spark plug is disposed at a predetermined interval side by side to the fuel injector 10 in a central part of the ceiling inner wall of the cylinder head 102. The spark electrode and the ground electrode are disposed in such a manner so as to face each other across a discharging gap. The spark discharging of the spark electrode and the ground electrode across the discharging gap in a fuel jet and the fuel spray creates a flame core, which spreads over the surrounding air-fuel mixture to grow to a flame to thereby start combustion.

As shown in FIG. 1, the fuel injector 10 is disposed in the central part of the ceiling inner wall of the cylinder head 102. A mounting location of the fuel injector 10 for a cylinder of the engine 100 is not limited to what is shown in FIG. 1. For instance, the fuel injector 10 may be disposed in a corner part of the ceiling inner wall of the cylinder head 102 (for example, the intake port side) in such a manner that an axis 10*j* thereof is inclined relative to the axis of the combustion chamber 106 (hereinafter referred to as "inclination mounting").

The cylinder head 102 is provided with a fuel injector hole 105 for inserting the fuel injector 10 therein and therefore, a tip 75 of the fuel injector 10 is exposed to the combustion chamber 106. A boundary between the tip 75 and the fuel injector hole 105 is sealed air-tightly by a seal member 103 made of a resin or rubber material with heat resistance. Thus, the tip 75 is air-tightly sealed with the combustion chamber 106, and air in the combustion chamber 106 is introduced to the side of the tip 75 from a gap between the tip 75 and the fuel injector hole 105.

Pressured fuel is provided to the fuel injector 10 through a fuel distribution tube (not shown). Generally, a fuel pump (not shown) sucks in and discharges fuel from a fuel tank (not shown), and the discharged fuel is adjusted to a certain pressure level by a pressure regulator (not shown) or the like, which is then fed to the fuel distribution tube.

In a case where the engine 100 is a direct-injection engine as shown in the first embodiment, a pressure of fuel supplied to the combustion chamber 106 of the engine 100 is required to be approximately 2 MPa or more. Therefore, a high-pressure pump (not shown) additionally pressurizes fuel having a predetermined level of pressure (for example, 0.2 MPa) sucked from the fuel tank by the fuel pump, and the pressurized high-pressure fuel (for example, fuel in the range of 2 to 20 MPa) is fed to the fuel injector through the fuel distribution tube.

As shown in FIG. 1, the fuel injector 10 is formed in a substantially cylindrical shape which receives fuel from one end and injects fuel from the other end via an inside fuel passage 76. The fuel injector 10 is provided with a valve part B which blocks and allows a fuel injection, an electromagnetic drive part S which drives the valve part B, and an air introducing aperture 80 (e.g., a hole) for introducing air into the hollow area of the hollow spray. The fuel injector 10 injects fuel flowing in the fuel passage into the cylinder of the engine from the valve part B.

The fuel injector 10 injects and forms a fuel spray in a fuel jet. In one embodiment, the fuel spray is formed in a hollow, conical shape so as to include a hollow space within the spray. Generally, the shape of the hollow spray is described in the following manner. For example, in the spray film of the hollow conical shape, an opening angle $\alpha$ in the spray film within the hollow space is used as an index for the hollow spray shape and is called a "spray angle."

As shown in FIG. 1, the valve part B includes the valve body 12, a needle 30 as a valve member, and a housing 16. The valve body 12 constitutes a portion of the tip 75 of the fuel injector 10. The tip 75 includes a tip face 77 that is provided in the combustion chamber 106.

The valve body 12 is fixed to an inner wall of the fuel injector-side end face of a housing 16 (hereinafter referred to as "valve housing") by welding and so forth. The valve body 12 is formed in a substantially cylindrical and stepped shape with a bottom, and is inserted into an inner peripheral side of a lower end part of the valve housing 16. An outer peripheral side of the valve body 12 is reduced in diameter downward from the step as a boundary. Thus, the step contacts with a step formed on an inner peripheral side of the valve housing 16, which limits the valve body 12 moving from the valve housing 16 (e.g., due to fuel pressure).

The fuel passage 76 extends through the valve body 12, and the needle 30 is movably provided in the fuel passage 76. Fuel flowing from the outside of the fuel injector 10 and flowing in the inside fuel passage 76 is introduced to an inner peripheral side of the valve body 12. The valve body 12 includes a frustoconical face 13 as an inner peripheral face, which is reduced in diameter in a fuel stream direction. The frustoconical face 13 constitutes the valve seat 14 which the needle 30 is seated on and moves away from. More specifically, a contacting part 31 of the needle 30 is seated on and moves away from the valve seat 14. The needle 30 is formed in a substantially axial shape, and is able to axially reciprocate in the valve body 12. The valve seat 14 and the contacting part 31 constitutes a seat part which works as an oil seal function for the valve part B to stop the injection of fuel.

As shown in FIG. 2, the terminal end of the contacting part 31 of the needle 30 is flat. When the fuel injector is closed and the needle 30 is seated on the valve seat 14, a space 90 remains between the terminal end of the needle 30 and the frustoconical face 13.

Generally, the needle 30 is seated on and moves away from the valve seat 14 of the valve body 12 repeatedly at every fuel injection, which therefore, requires a relatively strong abrasion resistance. Therefore, in one embodiment, the valve seat 14 is made of a material with relatively high abrasion resistance. In one embodiment, the entire valve body 12 is made out of the high-abrasion resistance material. Also, the valve housing 16 for connection to other members such as an electromagnetic drive member S (more specifically, a tube member 40) may be made of materials different than the valve seat 14 to thereby reduce manufacturing costs. In another embodiment, the valve body 12 and the housing 16 are made of the same material and are formed as a unit.

As shown in FIGS. 1 and 2, a plurality of the nozzle holes 20 are included in the valve body 12. The nozzle holes 20 (eight nozzle holes in the first embodiment) extend from the valve seat 14 to the tip face 77. In other words, the nozzle holes 20 are in fluid communication with the space 90 adjacent the valve seat 14, and the nozzle holes 20 extend through the valve body 12 to fluidly communicate the fuel passage 76 and the combustion chamber 106 (i.e., an area outside the fuel injector 10). As such, reciprocal movement of the needle 30 (i.e., seating and unseating of the needle 30) opens and closes the nozzle holes 20. It is appreciated that only two of the nozzle holes 20 are shown in FIG. 1 for clarity. FIG. 2, on the other hand, shows all eight of the nozzle holes 20. It will be appreciated that there could be any suitable number of nozzle holes 20 without departing from the scope of the present disclosure.

A size, an axial direction, and an arrangement of the nozzle hole 20 is determined depending on the required shape, direction, and number of fuel sprays. The open area of the nozzle holes 20 effects a fuel flow amount when the valve is open. More specifically, a fuel injection quantity of the fuel injector 10 is calculated according to the open area of the nozzle hole 20 and a lift amount and a valve opening duration of the needle 30. When the needle 30 is seated on the valve seat 14, the fuel injection from the nozzle hole 20 is stopped and when the needle 30 moves away from the valve seat 14, the fuel injection is injected from the nozzle hole 20.

Figure 3:
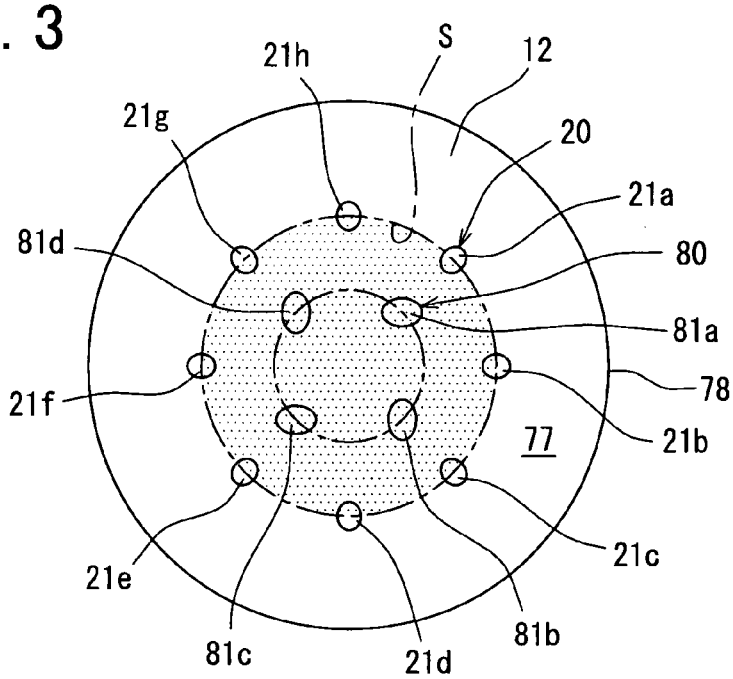
FIG. 3 is a plan view of the tip part taken on line III-III of FIG. 2.

As shown in the embodiment of FIG. 3, the nozzle holes 20 are arranged at equal intervals on a predetermined circle of the tip face 77. The respective axis of the nozzle holes 20 is inclined at an angle to the fuel injector axis 10*j* (i.e., a valve body axis 12*j*) for an outlet 21 of the nozzle hole 20 to be directed outward from the tip face 77. Fuel injected by the plurality of the nozzle holes 20 forms the hollow spray.

As shown in FIG. 2, the nozzle hole 20 is a straight cylinder in which an inlet 22 (hereinafter referred to as "nozzle hole inlet") and an outlet 21 (hereinafter referred to as "nozzle hole outlet") of the nozzle hole 20 are of the same size. A form of the nozzle hole 20 is not limited to the above arrangement, and it may be a taper shape expanding in diameter toward the nozzle hole outlet 21.

More specifically, the eight nozzle hole outlets 21*a*, 21*b*, 21*c*, 21*d*, 21*e*, 21*f*, 21*g*, 21*h* are arranged at substantially equal intervals on a circle shown by the broken line in FIG. 3. As such, an area S is defined between the nozzle hole outlets 21*a*-21*h* as indicated in FIG. 3.

As shown in FIG. 3, a plurality of air introducing apertures 80 are also included in the tip 75 (i.e., the valve body 12) of the fuel injector 10. In the embodiment shown, there are four air-introducing apertures 80; however, there can be any suitable number of air introducing apertures 80 without departing the scope of the present disclosure. Also, in FIGS. 1 and 2, only two of the air introducing apertures 80 are shown for clarity.

As shown in FIG. 2, the air introducing apertures 80 each have a straight axis. Each air-introducing aperture 80 includes an air inlet port 82 (i.e., an inlet) and an air outlet port 81 (i.e., an outlet), which are of the same size. at the tip face 77. The form of the air-introducing aperture 80 is not limited to the above arrangement, but it may be a shape other than this, and may be any hole shape as long as it is arranged not to intersect with the nozzle hole 20.

As shown in FIG. 2, the air introducing aperture 80 extends through the valve body 12 at an angle inclined relative to the axis 10*j* of the injector 10 (i.e., the axis 12*j* of the valve body 12) such that the inlet ports 82 are on a side surface 78 of the valve body 12, and the outlet ports 81 are included on the tip face 77. Furthermore, as shown in FIG. 3, the air introducing apertures 80 are arranged in a circle on the tip face 77 as indicated by a broken line. Thus, airflow is directed through the air introducing apertures 80 in a direction toward the axis 10*j* of the injector (i.e., the axis 12*j* of the valve body 12). The air outlet ports 81 are included on the tip face 77 between the in the area S between the nozzle hole outlets 21*a*-21*h*.

As shown in FIG. 3, the air outlet port 81 is disposed to be directed toward a region between each nozzle hole outlet 21. In other words, the axis of each of the air introducing apertures 80 extends between the axes of a pair of nozzle holes 20. More specifically, in the four air outlet ports 81*a*, 81*b*, 81*c*, 81 *d*, the air outlet port 81*a* is disposed to be directed toward a region between the nozzle hole outlets 21*a* and 21*b*. The air outlet port 81*b* is disposed to be directed toward a region between the nozzle hole outlets 21*c* and 21*d*. The air outlet port 81*c* is disposed to be directed toward a region between the nozzle hole outlets 21*e* and 21*f*. The air outlet port 81*d* is disposed to be directed toward a region between the nozzle hole outlets 21*g* and 21*h*. The air introducing apertures 80 and the nozzle holes 20 are offset in a circumferential direction in relation to each other and in relation to the axis 12*j*.

As shown in FIG. 1, the electromagnetic drive part S is provided with a tube member 40, a movable core 50, a stationary core 50, and a coil 60. The tube member 40 is inserted into an inner peripheral wall at the opposite side to the nozzle hole of the valve body 12 (more specifically, the valve housing 16), and is fixed on the valve body 12 through the valve housing 16 by welding and so forth. The tube member 40 is composed of a first magnetic tube part 42, a non-magnetic tube part 44, and a second magnetic tube part 46 in the order from the side of the nozzle hole 20. The non-magnetic tube part 44 prevents a magnetic short between the first magnetic tube part 42 and the second magnetic tube part 46, which makes it possible for a magnetic flux of an electromagnetic force caused by a power supply of the coil 60 to efficiently flow into the movable core 50 and the stationary core 54.

The movable core 50 is made of a magnetic material, formed in a substantially conical and stepped shape, and fixed to an end part at the opposite side of the nozzle hole of the needle 30 by welding and so forth. The movable core 50 reciprocates with the needle 30. An outlet hole 52 penetrating through a tube wall of the movable core 50 forms an inside fuel passage which communicates the inside and outside of the movable core 50.

The fixed core 54 is made of a magnetic material, and formed into a substantially cylindrical and stepped shape. The fixed core 54 is inserted into the tube member 40, and fixed in the tube member 40 by welding and so forth. The fixed core 54 is disposed at the opposite side of the nozzle hole to face the movable core 50. An adjusting pipe 56 is press-fitted into an inner periphery of the stationary core 54 to form a fuel passage therein. A spring 58 as a biasing member is engaged at one end part by the adjusting pipe 56, and at the other end part by the movable core 50. A press-fitting amount of the adjusting pipe 56 is adjusted to change a load of the spring 58 urging the movable core 50. A urging force of the spring 58 causes the movable core 50 and the needle 30 to be urged toward the valve seat 14.

The coil 60 is wound around a spool 62. A terminal 65 is insert-molded into a connecter 64, and connected electrically to the coil 60. When the coil 60 is energized, a magnetic suction force acts between the movable core 50 and the stationary core 54, and the movable core 50 is sucked to the side of the stationary core 54 against the urging force of the compressing spring 58.

Next, an operation of the fuel injector 10 with such structure in the first embodiment will be explained. To inject fuel, current is supplied to the coil 60 of the fuel injector 10 and the needle 30 moves away from the valve seat 14 to start the lift. As a result, the valve part B opens to start injection of fuel from the nozzle hole 20. The fuel jet injected from the nozzle holes 20 gets atomized, which forms the hollow spray in the combustion chamber 106 of the engine 100. To stop fuel injection, the current supply to the coil 60 is stopped, and the lift amount of the needle 30 decreases because of the urging force of the spring 58. When the needle 30 is seated on the valve seat 14, the fuel injection from the nozzle holes 20 finishes. By adjusting the power supply duration to the coil 60, the fuel (fuel spray) injection duration, that is, a fuel injection amount from the fuel injector 10 is adjusted.

The fuel spray injected from the nozzle hole outlets 21 produces friction with the air from the downstream side space in accordance with an inside energy of the fuel jet to generate a shear due to friction of the fuel at the tip face 77 with the air. As a result, this shear produces a vortex flow, and therefore, the fuel jet (i.e., the fuel spray) diffuses more toward the tip face 77 and is atomized.

On the other hand, at the side of the fuel jet injected from the nozzle hole outlet 21, the inside energy of the fuel jet is relatively large since it is just after the fuel injection. Therefore, the friction between fuel at the nozzle hole outlet-side of the fuel jet and the air is generated, but the air generating the friction and the surrounding air are carried away by its relatively large inside energy of the fuel jet.

In a case when a spray form is the hollow spray such as a spray of the hollow conical shape, an inner peripheral side of the spray film is a limited space as the hollow part disposed at the inner peripheral side in comparison to the size of the surrounding air space at the outer peripheral side of the conical spray film. Therefore, the hollow part has a limit in its space capacity to replace the air when the air is taken away to a downstream side space by the fuel jet at the nozzle hole outlet side. As a result, there is a possibility that the spray angle $\alpha$ of the hollow spray reduces caused by that pressure in the hollow part of the hollow spray decreases as compared to the surrounding air pressure at the outer peripheral side of the spray film.

However, according to the first embodiment described above, the nozzle holes 20 and the air introducing apertures 80 are disposed in the valve body 12 at the tip 75 of the fuel injector 10 and are in communication with the combustion chamber 106. The air outlet port 81 of the air-introducing aperture 80 is disposed between the nozzle hole outlets 21.

Accordingly, it is possible to introduce air from the air outlet ports 81 into the hollow space of the fuel spray. Therefore, the pressure decrease in the hollow space is alleviated even in a case of possibly decreasing the pressure in the hollow part of the hollow spray by the fuel jet injected from the nozzle hole outlet 21. Therefore, in the fuel injector which injects fuel and forms the hollow spray, it is easier to control the reduction of the spray angle $\alpha$ of the hollow spray.

In the first embodiment described above, the air introducing apertures 80 penetrate the valve body 12 from the side surface 78 of the valve body 12 to the tip face 77. In addition, the air introducing apertures 80 and the nozzle holes 20 are arranged to be offset relative to each other in the circumferential direction relative to the axis 12*j* of the valve body 12. Accordingly, the air outlet ports 81 and the nozzle holes 20 are independent of each other and do not cross. Therefore, it is possible to inject fuel for the hollow spray from the nozzle hole outlets 21 and to introduce the surrounding air at the side of the valve body 12 (more specifically the air in the combustion chamber 106) through the air introducing apertures 80, and the air flows from the air outlet port 81 toward the nozzle hole outlets 21.

Since the air introducing aperture 80 and the nozzle hole 20 are arranged to be offset relative to each other in the circumferential direction, it may not be necessary to locate each air outlet port 81 corresponding to each nozzle hole outlet 21. Thus, locating the air introducing apertures 80 is relatively flexible. For instance, it is possible to give priority to the locations of the nozzle hole outlets 21*a*-21*h* to generate the desired fuel spray, and then the air outlet ports 81 can be located between those nozzle hole outlets 21.

Further, in the first embodiment, when the fuel injector is closed, the space 90 is defined by the needle 30 and the conical face 13. In the embodiment shown, the space 90 is flat. The nozzle holes 20 can be easily formed in the valve body 12 so as to communicate with the flat space 90. Even when a plurality of the nozzle holes 20 are included in the valve body 12, it is possible to ensure the flexibility in the predetermined location of the nozzle holes 20 by utilizing the width of the space 90.

In the first embodiment described above, the air introducing aperture 80 is able to communicate the air in the combustion chamber 106 to the air inlet port 82 and discharge the air from the air outlet port 81 due to the differential pressure between the combustion chamber 106 and the inside of the hollow part of the hollow spray. Accordingly, the air guided from the air outlet port 81 to the nozzle hole outlet 21 is able to circulate the air in the combustion chamber 106 in a fairly simple manner without having to introduce air through the air outlet port 81 from outside the combustion chamber 106. Instead, air in the combustion chamber 106 circulates by flowing into the air inlet ports 82 of the air introducing apertures 80 and out of the air outlet ports 81 of the air-introducing aperture 80.

Second Embodiment

Figure 4:
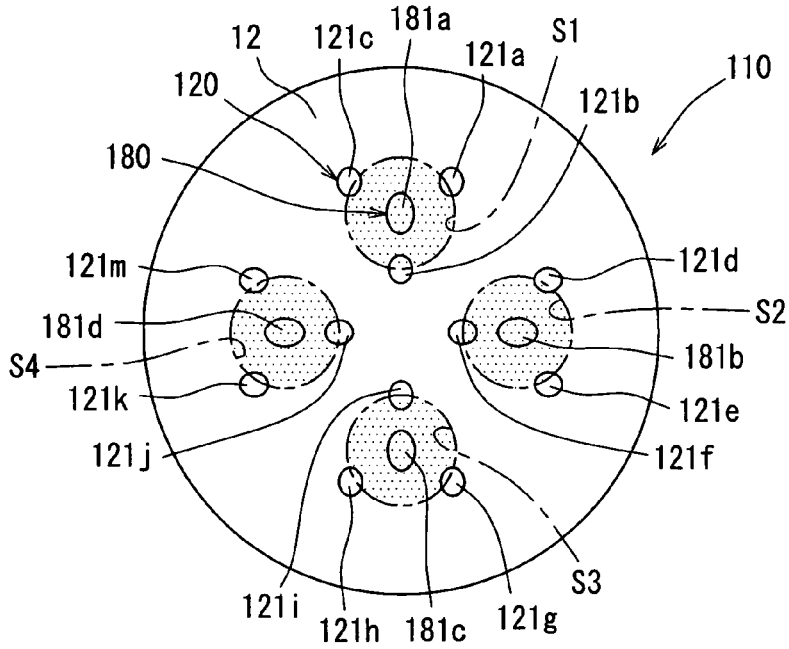
FIG. 4 is a plan view of the tip part in a second embodiment.

Referring now to FIG. 4, another embodiment is illustrated. Components that are similar to those described above are indicated by similar numbers increased by 100.

As shown in FIG. 4, the injector 110 includes a plurality of nozzle holes 120 is included such that the corresponding nozzle hole outlets 121 are arranged into separate groups. An air outlet port 181 is arranged between each group of nozzle hole outlets 121.

In the embodiment shown, there are four groups of three nozzle hole outlets 121; however, there can be any number of groups and each group can have any appropriate number of nozzle hole outlets 121 without departing from the scope of the present disclosure. Also, in the embodiment shown, there is only one air outlet port 181 in each group of nozzle hole outlets 121; however, there can be any number of air outlet ports 181 in the group of nozzle hole outlets 121 without departing from the scope of the present disclosure. More specifically, this arrangement is formed of four groups as follows: three nozzle hole outlets 121*a*, 121*b*, and 121*c* (hereinafter referred as to "first group"), three nozzle hole outlets 121*d*, 121*e*, and 121*f* (hereinafter referred as to "second group"), three nozzle hole outlets 121*g*, 121*h*, and 121*i* (hereinafter referred as to "third group"), and three nozzle hole outlets 121*j*, 121*k*, and 121*m* (hereinafter referred as to "fourth group").

In each of the first, second, third and fourth groups, air outlet ports 181*a*, 181*b*, 181*c*, and 181*d* are arranged in a corresponding area S1, S2, S3, S4 between the respective nozzle hole outlets 121. Each group of nozzle hole outlets 121 is able to form an individual hollow spray. With such arrangement, each group can achieve the same effect as the first embodiment.

Third Embodiment

Figure 5:
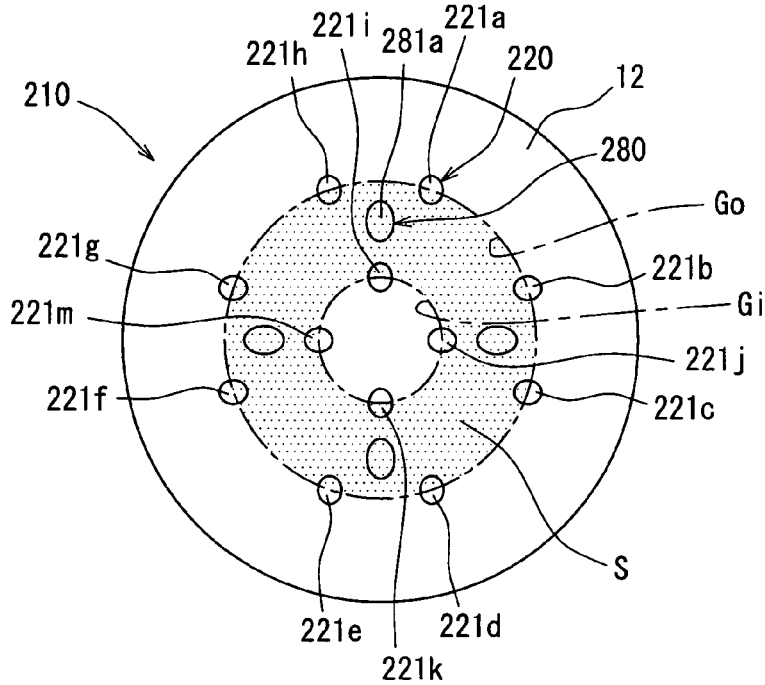
FIG. 5 is a plan view of the tip part in a third embodiment.

Referring now to FIG. 5, another embodiment is shown. Components that are similar to those of the first embodiment are indicated by similar numbers increased by 200. In the embodiment shown, the injector 210 includes a plurality of nozzle hole outlets 221 (e.g., twelve nozzle hole outlets 221 in the embodiment shown). The nozzle hole outlets 221 are arranged in an outer peripheral spray group Go and an inner peripheral spray group Gi, each indicated by a broken circular line. The inner and outer peripheral spray groups Gi, Go define concentric circles, and the inner peripheral spray group Gi is encompassed by the outer peripheral spray group Go. In the embodiment shown in FIG. 5, the outer peripheral spray group Go includes eight nozzle hole outlets 221*a*, 221*b*, 221*c*, 221*d*, 221*e*, 221*f*, 221*g*, 221*h*, and the inner peripheral spray group Gi includes four nozzle hole outlets

221*i*, 221*j*, 221*k*, 221*m*. Individual hollow sprays are formed by the nozzle hole outlets 221*a*-221*h* of the outer peripheral-side spray group Go and the nozzle hole outlets 221*i*-221*m*. As such, a double hollow spray is formed wherein the spray from the inner peripheral spray group Gi is formed in the spray from the outer peripheral spray group Go.

A space S is defined between the inner and outer peripheral spray groups Gi, Go. The air outlet ports 281 are disposed within the space S. With such arrangement, in the hollow spray formed at least in the outer peripheral-side spray group Go, it is possible to achieve the same effect as the first embodiment.

Generally, in the double spray, air is largely carried away by the fuel jet in a space between the inside of a spray film of the hollow spray formed by the outer peripheral-side spray group Go, and the outside of the spray film of the hollow spray formed by the inner peripheral-side spray group Gi (hereinafter referred as to "double spray hollow part"). With the embodiment shown, it is possible to effectively introduce air between the spray of the outer peripheral-side spray group Go and the inner peripheral-side spray group Gi.

Fourth Embodiment

Figure 6:
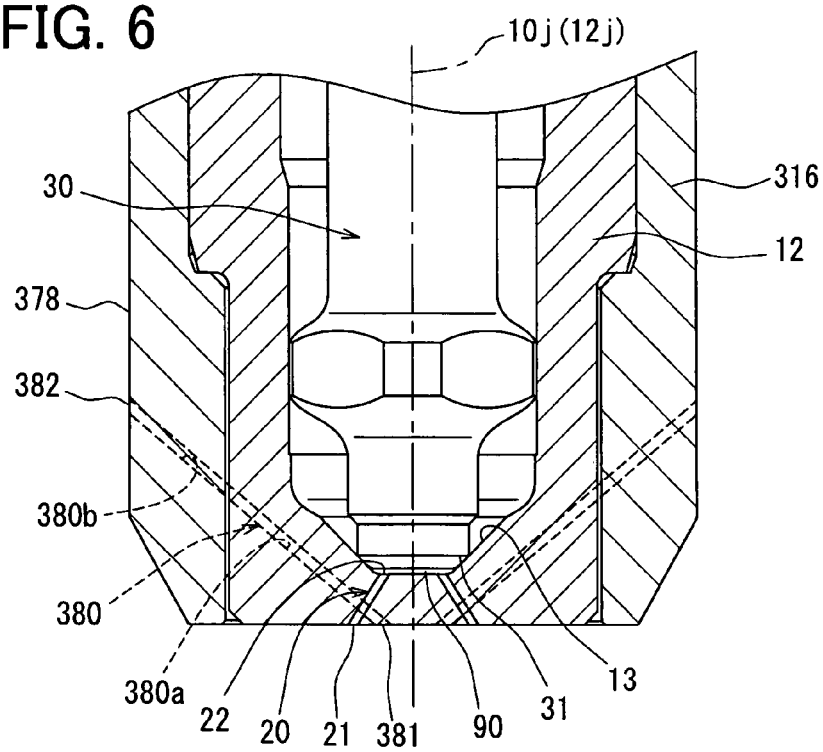
FIG. 6 is a cross sectional view of the tip part of the fuel injector according to a fourth embodiment.

Referring now to FIG. 6, another embodiment is shown. Components similar to the first embodiment are indicated by similar numbering increased by 300. In the embodiment of FIG. 6, the air-introducing aperture 380 extends through both the valve body 12 and a valve housing 316.

As shown in FIG. 6, the valve housing 316 is fixed to the valve body 12 in such a manner as to accommodate an outer periphery of the valve body 12.

The air introducing aperture 380 includes a first air introducing aperture part 380*a* including an air outlet port 381 formed in the valve body 12 and a second air introducing aperture part 380*b* including an air inlet port 382 formed in the valve housing 316. The first air introducing aperture part 380*a* and the second air introducing aperture part 380*b* are in communication.

More specifically, the air introducing aperture 380 forms the air inlet port 382 at a side surface 378 of the valve housing 316, and penetrates through from the side surface 378 of the valve housing 316 toward a tip 75 face of the valve body 12. With such arrangement, the same effect as the first embodiment can be achieved.

Fifth Embodiment

Figure 7:
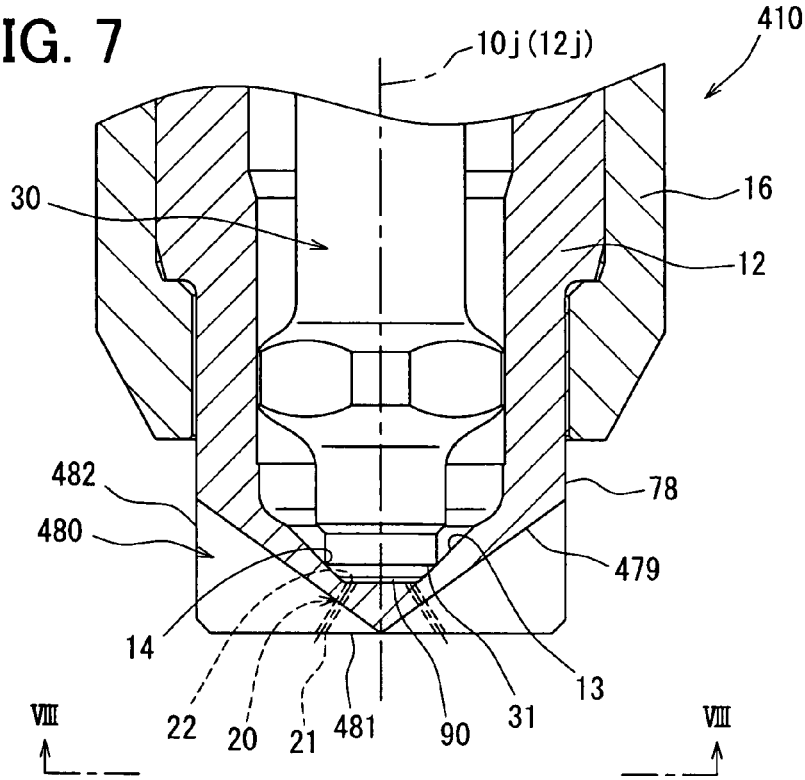
FIG. 7 is a cross sectional view of the tip part of the fuel injector according to a fifth embodiment.
Figure 8:
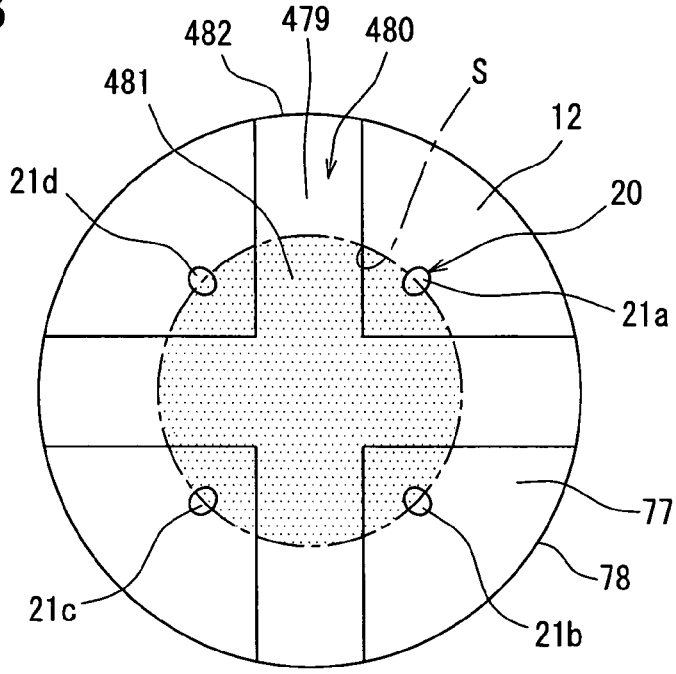
FIG. 8 is a plan view of the tip part taken on line VIII-VIII of FIG. 7.

FIGS. 7 and 8 show another embodiment. Components similar to those of the first embodiment are indicated with similar numbers increased by 400. In this embodiment, the air-introducing aperture is a groove 480. More specifically, the fuel injector 410 includes a plurality of grooves 480 disposed in the valve body 12. The grooves 480 each function as the air introducing port similar to as disclosed above.

As shown in FIG. 8, a plurality (e.g., four) nozzle hole outlets 21*a*, 21*b*, 21*c*, 21*d* are disposed at equal intervals on a predetermined circle on a tip face 77 of the valve body 12. Fuel injected from the nozzle hole outlets 21*a*, 21*b*, 21*c*, 21*d* forms a substantially hollow frustoconical shaped spray at the downstream side of an area S surrounded by these injection hole outlets.

Each groove 480 extends from the side surface 78 radially toward the axis 12*j* of the valve body 12 between two of the outlets 21*a*-21*d* of the nozzle holes 20. Also, each groove 480 extends toward the tip face 77 such that the depth of each groove 480 decreases in the direction from the side surface 78 toward the axis 12*j* of the valve body 12. As such, each groove 480 defines an angled surface 479 that is at an acute angle relative to the axis 12*j* of the valve body 12. In the embodiment shown, there are four grooves 480 spaced perpendicular to each other such that the grooves 480 are arranged in a cross-like shape. Also, the grooves 480 each include an air inlet port 482 adjacent the side surface 78 and an air outlet port 481 adjacent the tip face 77. Thus, air can flow from outside the fuel spray into the respective groove 480 through the inlet port 482. Also, air can flow out of the groove 480 and into the hollow portion of the fuel spray through the portion of the outlet port 481 that is within the space S.

Sixth Embodiment

Figure 9:
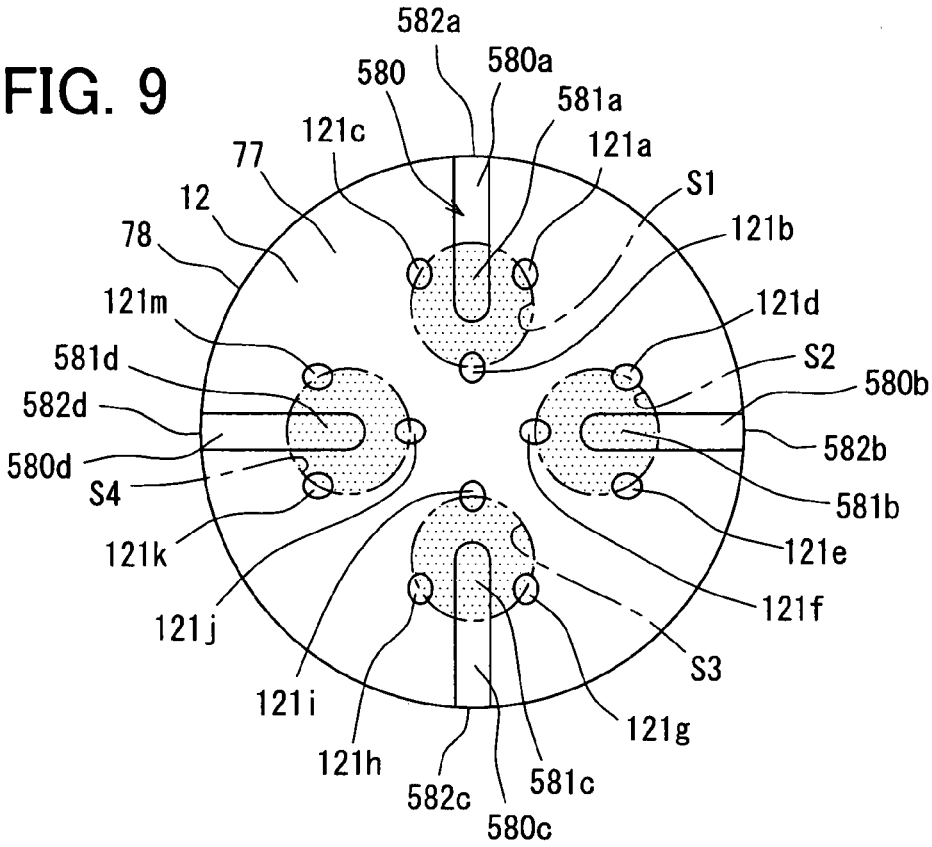
FIG. 9 is a plan view of the tip part in a sixth embodiment.

FIG. 9 shows a sixth embodiment. The sixth embodiment is applied to another example of a fuel injector in which a groove 580 disposed in a valve body 12 is used as an air introducing port.

In the tip face 77 of the valve body 12, there are a plurality (e.g., twelve) of nozzle hole outlets 121*a*-*k*. The nozzle hole outlets 121*a*-*k* are arranged into a plurality (e.g., four) of groups with a plurality (e.g., three) of nozzle hole outlets 121 in each group. Furthermore, the valve body 12 includes a plurality (e.g., four) of grooves 580*a*, 580*b*, 580*c*, 580*d*. Each groove 580*a*-580*d* provides fluid communication into the space S1, S2, S3, S4 between the nozzle hole outlets 121 of a single group. The grooves 580*a*-580*d* each extend radially from a side face 78 toward the respective space S1, S2, S3, S4.

The grooves 580*a*-580*d* each include an air inlet port 582*a*-582*d* and an air outlet port 581*a*-581*d*. The air inlet ports 582*a*-582*d* are provided on the side surface 78 of the valve body 12, and the air outlet ports 581*a*-581*d* are provided on the tip face 77 of the valve body 12. A portion of the air outlet ports 581*a*-581*d* is located between the nozzle hole outlets 121*a*-121*k* of the corresponding group. Thus, air from outside the fuel spray can flow into the air inlet ports 582*a*-582*d*, through the grooves 580*a*-580*d*, and into the hollow portion of the fuel spray from the air outlet portions 581*a*-581*d*.

Other Embodiments

As described above, the embodiments of the present disclosure are explained. However, the present invention is not limited to the above interpretation for the embodiment, but is able to be applied to various embodiments within the spirit of the intended purpose of the present invention.

In the embodiments mentioned above, the locations of the nozzle holes 21 are explained as to be arranged at equal circumferential intervals about the axis 12*j*. However, the nozzle holes 21 may be disposed at unequal intervals. The form of the nozzle hole 21 is explained as a straight cylinder. However, the nozzle holes 21 may be formed as tapered cylinders or a slitting form to a hole shape such as a cylinder. The same is true of the location and the form of the air-introducing aperture 80.

In the fifth and sixth embodiments, it is explained that the grooves 480 extend from the side face 78 to the tip face 77 of the valve body 12. However, the grooves 480 may merely extend over the tip face 77 without intersecting the side face 78.

In the sixth embodiment explained above, twelve nozzle hole outlets 121*a*-121*k* and *m* are divided into four groups in such a manner as to set three nozzle hole outlets as one group, and each groove 580*a*, 580*b*, 580*c*, 580*d* is provided from the non-nozzle hole arrangement area S1, S2, S3, and S4 of the nozzle hole outlet of the each group toward the radial outside direction. However, the grooves 580*a*, 580*b*, 580*c*, and 580*d* are not limited to such an arrangement as to be provided between the four groups of the nozzle hole outlets 121*a*-121*k*, 121*m*, but may be in the following arrangement.

More specifically, the twelve nozzle hole outlets 121*a*-121*k*, 121*m* are formed of the nozzle hole outlet of the outer peripheral-side spray group and the nozzle hole outlet of the inner peripheral-side spray group. It may provide the groove 580*a*, 580*b*, 580*c*, 580*d* from the non-nozzle hole arrangement area where the nozzle hole outlet of the outer peripheral-side spray group and the outer peripheral-side spray group is not disposed, toward the radial outside direction.

While only the selected example embodiments have been chosen to illustrate the present disclosure, it will be apparent from this disclosure that various changes and modifications can be made therein without departing from the scope of the disclosure as defined in the appended claims. Furthermore, the foregoing description of the example embodiments according to the present disclosure is provided for illustration only, and not for the purpose of limiting the disclosure as defined by the appended claims and their equivalents.

What is claimed is:

1. A fuel injector comprising:

a valve body with a plurality of nozzle holes for injecting fuel in a hollow spray from the fuel injector, the plurality of nozzle holes each including an outlet;

wherein the valve body also includes at least one air-introducing aperture with an air outlet port provided between the outlets of the plurality of nozzle holes, the air introducing aperture for introducing air into a hollow area of the hollow spray, and wherein the air introducing aperture is located radially inward of a radially outermost one of the plurality of nozzle holes; and a plurality of air outlet ports, wherein the plurality of nozzle holes are arranged in a plurality of groups of at least three, and wherein each of the air outlet ports is provided between the outlets of one group of the nozzle holes.

2. A fuel injector comprising:

a valve body with a plurality of nozzle holes for injecting fuel in a hollow spray from the fuel injector, the plurality of nozzle holes each including an outlet;

wherein the valve body also includes at least one air-introducing aperture with an air outlet port provided between the outlets of the plurality of nozzle holes, the air introducing aperture for introducing air into a hollow area of the hollow spray, and wherein the air introducing aperture is located radially inward of a radially outermost one of the plurality of nozzle holes; and wherein the plurality of nozzle holes are arranged in an inner peripheral-side nozzle hole group and an outer peripheral-side nozzle hole group, wherein the inner peripheral-side nozzle hole group is encompassed by the outer peripheral-side nozzle hole group, and wherein the air outlet port is provided between the outlets of the inner peripheral-side nozzle hole group and the outlets of the outer peripheral-side nozzle hole group.

3. A fuel injector according to claim 2, wherein fuel injected from the inner peripheral-side nozzle hole group and the outer peripheral-side nozzle hole group forms a double hollow spray.

4. A fuel injector comprising:

a valve body with a plurality of nozzle holes for injecting fuel in a hollow spray from the fuel injector, the plurality of nozzle holes each including an outlet;

wherein the valve body also includes at least one air-introducing aperture with an air outlet port provided between the outlets of the plurality of nozzle holes, the air introducing aperture for introducing air into a hollow area of the hollow spray, and a plurality of air outlet ports, wherein the plurality of nozzle holes are arranged in a plurality of groups of at least three, and wherein each of the air outlet ports is provided between the outlets of one respective group of the nozzle holes.

5. A fuel injector comprising:

a valve body with a plurality of nozzle holes for injecting fuel in a hollow spray from the fuel injector, the plurality of nozzle holes each including an outlet;

wherein the valve body also includes at least one air-introducing aperture with an air outlet port provided between the outlets of the plurality of nozzle holes, the air introducing aperture for introducing air into a hollow area of the hollow spray, wherein the plurality of nozzle holes are arranged in an inner peripheral-side nozzle hole group and an outer peripheral-side nozzle hole group, wherein the inner peripheral-side nozzle hole group is encompassed by the outer peripheral-side nozzle hole group, and wherein the air outlet port is provided between the outlets of the inner peripheral-side nozzle hole group and the outlets of the outer peripheral-side nozzle hole group.

6. A fuel injector according to claim 5, wherein fuel injected from the inner peripheral-side nozzle hole group and the outer peripheral-side nozzle hole group forms a double hollow spray.

* * * * *